United States Patent [19]
Moretti

[11] 4,452,240
[45] Jun. 5, 1984

[54] RESPIRATORY PROTECTION APPARATUS

[75] Inventor: Anthony L. Moretti, San Rafael, Calif.

[73] Assignee: E. D. Bullard Company, Bridgeway, Calif.

[21] Appl. No.: 309,207

[22] Filed: Oct. 5, 1981

[51] Int. Cl.³ ..... A62B 7/00
[52] U.S. Cl. ..... 128/201.18; 128/201.26; 128/201.28; 128/201.23
[58] Field of Search ..... 128/201.23, 201.25, 128/201.26, 201.27, 201.28, 201.18, 346, 206.12, 202.27

[56] References Cited

U.S. PATENT DOCUMENTS

| | | | |
|---|---|---|---|
| 1,270,404 | 6/1918 | Garnett | 128/201.18 |
| 1,978,994 | 10/1934 | Fortunato | 128/201.28 |
| 3,266,490 | 8/1966 | Klinger et al. | 128/201.18 |
| 3,565,068 | 2/1969 | Bickford | 128/201.25 |
| 4,090,511 | 5/1978 | Gray | 128/201.18 |
| 4,154,235 | 5/1979 | Warncke | 128/201.25 |
| 4,231,359 | 11/1980 | Martin | 128/201.23 |
| 4,236,514 | 12/1980 | Moretti | 128/201.23 |
| 4,331,141 | 5/1982 | Pokhis | 128/201.25 |

*Primary Examiner*—Richard J. Apley
*Assistant Examiner*—Harry J. Macey
*Attorney, Agent, or Firm*—Robert W. Dilts

[57] ABSTRACT

A respiratory protection apparatus includes a nose engaging means for urging the outer walls of the nose toward the inner wall, which includes spaced-apart urging members, and a mouthpiece, said nose engaging means being rigidly secured to said mouthpiece. The apparatus further comprises a conduit arrangement for supplying air to said mouthpiece, said mouthpiece secured to a portion of the conduit arrangement, said conduit arrangement being sufficiently rigid so that said conduit arrangement can be used to direct said nose engaging means onto said nose and then direct the mouthpiece into the mouth of the worker. The apparatus further includes a valve for communicating with the conduit arrangement for allowing for the inhalation and exhalation of air.

9 Claims, 15 Drawing Figures

RESPIRATORY PROTECTION APPARATUS

TECHNICAL FIELD

The present invention is related to respiration equipment, and in particular to a respiratory protection apparatus for allowing a worker to have sufficient time to work in and escape a toxic environment.

BACKGROUND ART

A number of workplace respirators are presently available which are compact and locatable at job site safety points or carryable by the worker, for use by the worker when the work environment becomes temporarily toxic and hostile. Should such a hostile and toxic situation arise, the worker would place the respirator in operation, thereby allowing himself sufficient time to complete his assignment and/or leave the area without having the toxic environment impair his functioning.

Two general types of such workplace respirators include one class which has a full face mask covering the eyes, nose and mouth, or a partial face mask covering the nose and mouth, and another class which is limited to having a mouthpiece, and in some cases, a nose clamp. The full face mask respirator can be effective in operation; however, there is the problem of providing one basic mask which has the ability to conform to a multitude of different faces. Due to the lack of such a mask, there are sealing problems between the mask and the worker's face. If the respirator is connected to a pressurized source of air, the flushing action of the air entering the mask can keep the toxic gases from penetrating between the mask and the face. If, however, the respirator is merely a device which filters air inhaled by the worker, the loose fit can cause unfiltered and toxic air to enter the mask and affect the functioning of the worker. Due to the face that such respirators are only intended for use in emergency situations where the worker needs only one or two minutes to clear a hostile area, it would probably be commercially uneconomical to provide face masks which are specially fitted to each individual.

The other classification of respirators generally includes a mouthpiece which is gripped by the worker's teeth with his lips closing thereover. The respirator may also include a nose clamp which is fitted over the worker's nose to prevent his inadvertent inhalation of toxic gases through the nose while using the respirator. Such a device can be effectively used; however, it generally requires two hands to apply. One hand is used to place the mouthpiece in the worker's mouth, and the other is used to simultaneously place the nose clamp over the worker's nose. In some cases, due to the type of clamp, the worker is required to use two hands to properly position the nose clamp. Due to other equipment that the worker may have to simultaneously handle, he may not be able to devote two hands to positioning the respirator. Further, due to restrictions in his work dress, which can include, for example, a primary respiratory system with a head enclosure which for one reason or another was not functioning properly, the worker may not be able to place even one hand close enough to his face to properly position such a respirator. Also, excess time is required to properly position the respirator, which time the worker may not have.

The present invention is directed to overcoming one or more of the problems as set forth above.

DISCLOSURE OF THE INVENTION

In one aspect of the invention, a respiratory protection apparatus comprises a nose engaging arrangement for urging the outer wall of the nose surrounding the nostrils toward the septum, which means includes spaced-apart urging members and a mouthpiece. The nose engaging means is rigidly secured to said mouthpiece. A conduit arrangement for supplying air to said mouthpiece is rigidly secured to the mouthpiece. The conduit arrangement is sufficiently rigid so that said conduit arrangement can be used to direct the nose engaging arrangement onto a nose. The apparatus further includes a valve arrangement communicating with the conduit arrangement for allowing inhalation and exhalation of air, the valve arrangement being adapted to be connected to a source of air.

Unlike the prior art, such a device allows the worker to direct and engage the nose engaging arrangement and then the mouthpiece with one hand. The nose engaging means slips over the nose without the urging members thereof having to be separated as with the prior art. The nose engaging arrangement urges the outer walls of the nose into close proximity with the septum or inner wall without pinching the inner wall. When the worker attempts to inhale through his nose, the walls seal against the septum, preventing toxic fumes from entering.

Yet another aspect of the invention includes, in combination, a primary respiratory system including a head enclosure and means adapted for supplying air to said head enclosure, with an emergency egress respiratory protection apparatus at least partially extending into said head enclosure. The emergency egress respiratory protection apparatus comprises a mouthpiece and a nose engaging arrangement including spaced-apart urging members for urging the outer walls of the nose surrounding the nostrils toward the septum. The nose engaging arrangement is rigidly secured to those mouthpiece, and both are located in the head enclosure. Further, the emergency egress respiratory protection apparatus includes a conduit arrangement for supplying air to the mouthpiece. The mouthpiece is rigidly secured to a portion of said conduit arrangement, and the conduit arrangement is sufficiently rigid so that the conduit arrangement can be used to direct the nose engaging arrangement onto a nose. The conduit arrangement extends through said head enclosure and the apparatus further includes a valve arrangement outside the head enclosure communicating with the conduit arrangement for allowing inhalation and exhalation of air, said valve arrangement being adapted to be connected to a source of air.

With such an apparatus, should the primary respiratory system fail for any reason, the worker can apply the mouthpiece and the nose engaging arrangement, which are located in the head enclosure, by grasping the portion of the conduit arrangement located outside of the head enclosure and thereby so directing the mouthpiece and nose engaging arrangement. In such a situation, there is no need to disengage the primary respiratory system.

In yet another aspect of the invention, a respiratory protection apparatus comprises a nose engaging arrangement for urging the outer walls of the nose surrounding the nostrils towards the septum, which means includes spaced-apart urging members, a mouthpiece, said nose engaging arrangementt rigidly secured to said mouthpiece, a valve communicating with said mouthpiece for allowing inhalation and exhalation of air, and a filter communicating with said valve for filtering the inhaled air. This apparatus is principally for use in a situation where there is no other primary respiratory system being used. With one hand, the worker can slip the nose engaging means over the nose and engage the mouthpiece with his mouth in order to start breathing filtered air so that he can function properly in the hostile and toxic environment.

BEST MODE OF CARRYING OUT THE INVENTION

Figure 1:
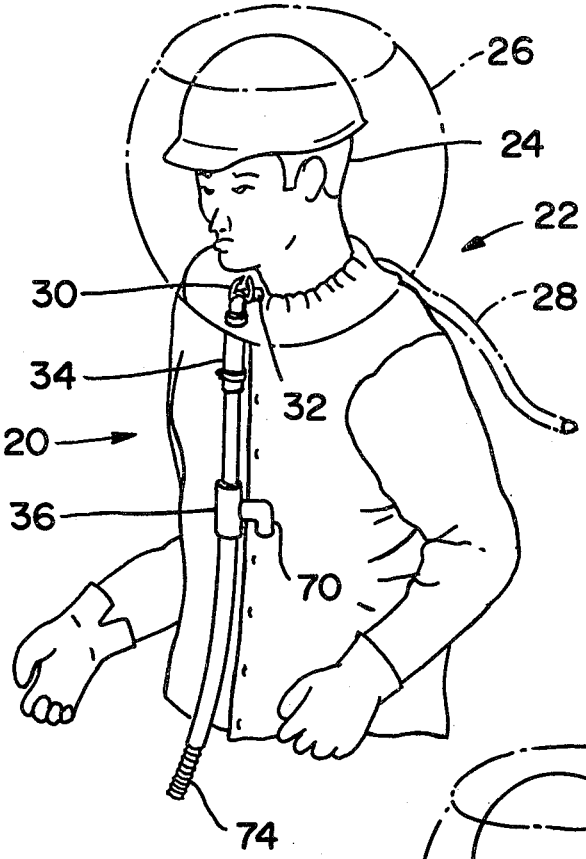
FIGS. 1 through 4 represent a perspective view of sequential steps in placing into operation an embodiment of the invention which is combined with a primary respiratory system.

With reference to the figures, and in particular to FIG. 1, a respiratory protection apparatus of the invention is depicted and denoted by numeral 20. Apparatus 20 is shown in combination with a primary respiratory system 22, which has been fitted over the head 24 of a worker. The primary respiratory system is described in U.S. Pat. No. 4,236,514, which was issued on Dec. 2, 1980, and which patent is incorporated herein by reference. The primary respiratory system includes a head enclosure 26, which can be comprised of a clear plastic material, and a conduit 28, through which air is supplied to the worker. Other features and aspects of the primary respiratory system 22 can be derived from a review of the above patent.

Figure 5:
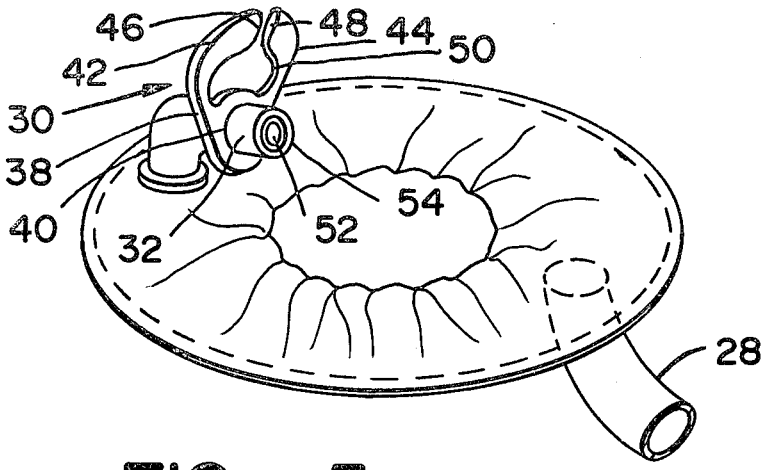
FIG. 5 depicts a perspective view of a portion of the embodiment of the invention of FIGS. 1 through 4 disposed in a portion of the primary respiratory system.
Figure 6:
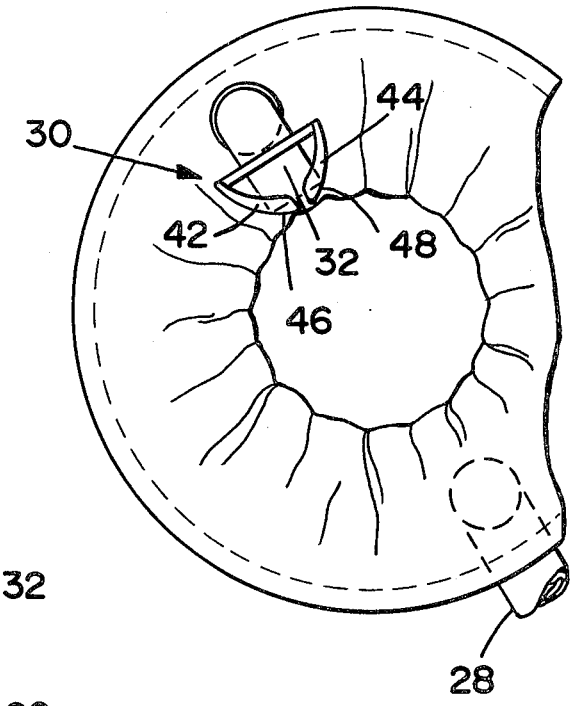
FIG. 6 depicts a plan view of FIG. 5.
Figure 7:
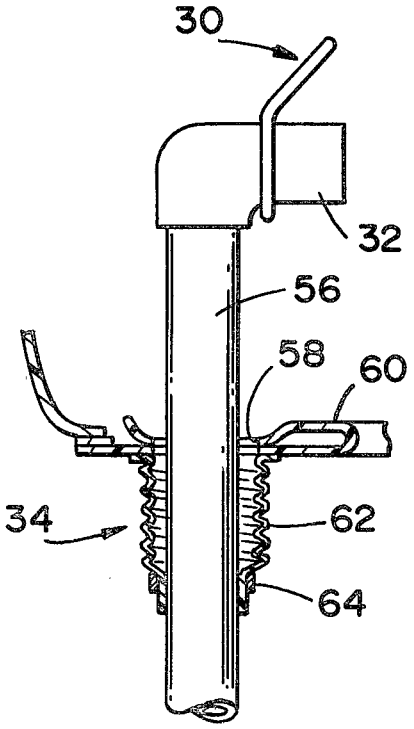
FIG. 7 depicts a side elevational view of a portion of the embodiment of the invention of FIG. 1 disposed through a portion of the primary respiratory system.

The respiratory protection apparatus 20 includes a nose engaging means 30, a mouthpiece 32, a conduit arrangement 34, and a valve 36 (FIG. 1). Nose engaging means 30 (FIG. 5) includes a base 38 which defines an aperture 40 which fits over and is secured rigidly to mouthpiece 32. Extending from base 38 are first and second urging members 42 and 44. Urging members 42 and 44 have substantially flat spaced-apart juxtaposed surfaces 46 and 48, which can be slid over the worker's nose, as described below. Urging members 42 and 44 define therebetween an enlarged aperture 50 which can receive a portion of the nose of the worker. As can be seen in FIG. 7, the urging members 42 and 44 are directed upwardly and away from the mouthpiece 32 at approximately a 45° angle. This orientation allows the worker to comfortably have the nose engaging means 30 applied to his nose, with the mouthpiece comfortably inserted into his mouth, as will be described more fully hereinbelow.

The mouthpiece 32 includes a non-deformable inner tube 52 and a softer, deformable outer tube 54. The worker's teeth are able to deform and better grip the outer tube, while the non-deformable inner tube prevents a worker from collapsing the mouthpiece.

The conduit arrangement 34 (FIG. 7) includes a rigid conduit 56 which extends through an aperture 58 in a base 60 of the head enclosure 26. Conduit arrangement 34 further includes a collapsible outer conduit or collar 62, which can be comprised of a plastic material much the same as the plastic material which comprises the head enclosure 26. The conduit communicates with aperture 58 at one end thereof, and the other end thereof is clamped about and to the rigid conduit 56 with a clamp 64.

Figure 8:
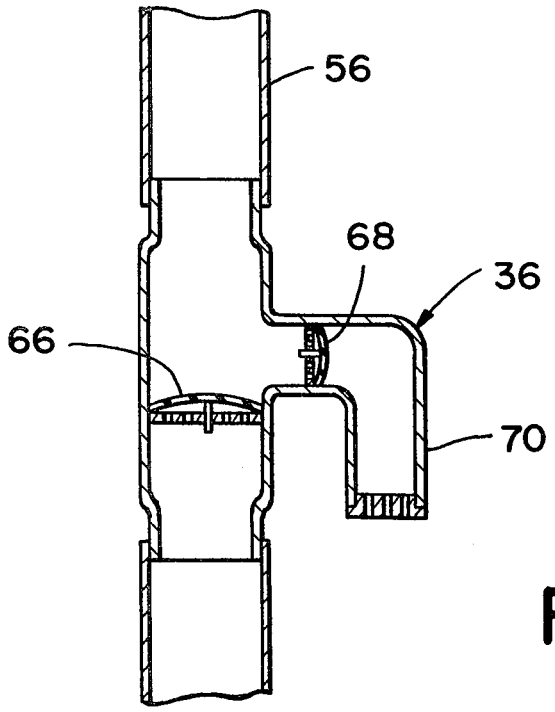
FIG. 8 discloses a cross-sectional view of a valve of the invention of FIG. 1.

The conduit arrangement 34 is secured to valve arrangement 36. As can be seen in FIG. 8, valve arrangement 36 includes a first one-way valve 66 which is opened during inhalation of air and closed during exhalation of air, and a second one-way valve 68 which is closed during inhalation of air and open during exhalation of air, so that the exhausted air can be directed through exhaust conduit 70. It is noted that exhaust conduit 70 is directed away from the head enclosure 26 and is quite a bit below it, so that the exhaust air with the moisture contained therein does not fog up the outside of the head enclosure 26, blurring the vision of the worker.

Figure 2:
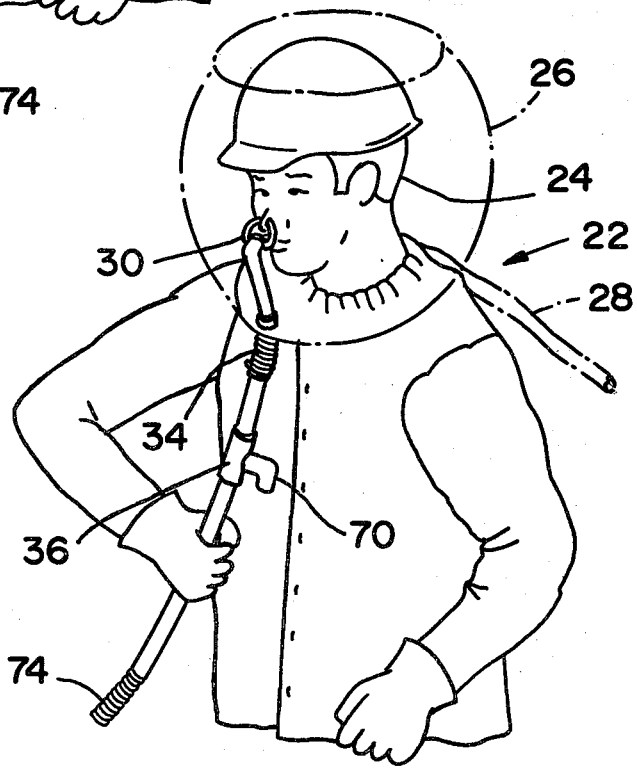
Figure 3:
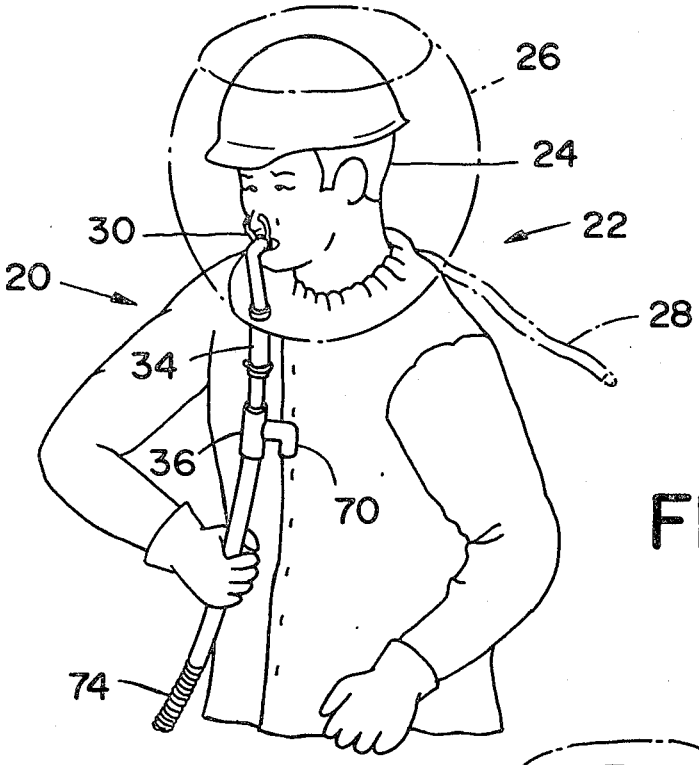
Figure 4:
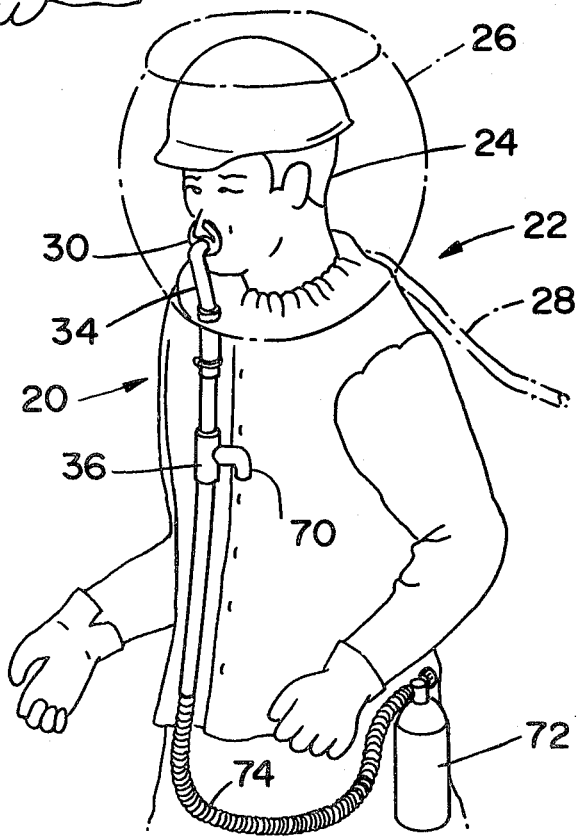

The operation of the respiratory protection apparatus 20 is as follows. If the worker finds the necessity for using apparatus 20 instead of primary respiratory system 22, he can grasp the rigid conduit 56 immediately below or above the valve arrangement 36, as shown in FIG. 2, so as to urge the nose engaging means 30 and mouthpiece 32 upwardly towards his face; collapsing the collapsible conduit 62 (FIG. 7). The urging members 42 and 44 of the nose engaging means 30 are urged over the outer walls of the wearer's nose, and in turn urge the outer walls toward the inner wall or septum. This placement of the nose engaging means 30 over the nose can be accomplished with only one hand from a remote location, as the worker cannot place his hands inside of the head enclosure 26. The spacing between the urging members 42 and 44 is slightly larger than the width of the septum of the worker's nose, which is a fairly standard size given the wide variety of sizes and shapes of facial features. In face, the spacing is such that the urging members 42 and 44 can be placed over the tip of the worker's nose and then pushed back onto the nose to urge the outer walls towards the inner wall.

With the nose engaging means so applied, the mouthpiece can be engaged by having the worker bite the soft outer tube of the mouthpiece with his teeth and then forming his mouth around the tube to provide a seal. With the nose engaging means 30 and mouthpiece 32 so positioned, the source of air or oxygen, which in this case can be bottled source 72, which communicates with conduit 56 through a flexible conduit 74, can be turned on to provide air to the worker.

Alternatively, an air source can be provided in substitution for bottled source 72, which can include an appropriate filter mechanism for removing toxic substances from the ambient environment. This source can also include, if desired, a fan arrangement for forcing air through the apparatus 20.

Figure 9:
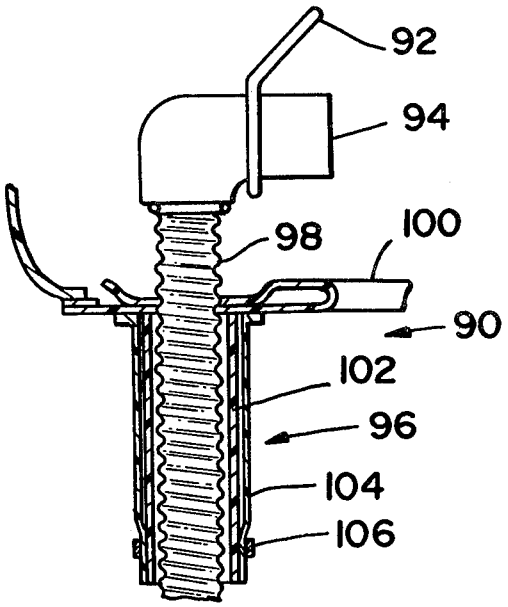
FIG. 9 depicts a side elevational view of an alternate embodiment of the invention.

An alternative of the embodiment of the invention is shown in FIG. 9 and designated 90. The alternate embodiment includes an engaging means 92 and a mouthpiece 94, which are similar to those previously described, and a modified conduit arrangement 96. The modified conduit arrangement includes a flexible conduit 98, which is secured to the mouthpiece 94 and extends through the base 100 of the head enclosure. A rigid middle tube 102 is disposed about the flexible conduit 98. A flexible outer tube or collar 104, which is comprised of a material which is similar to that of the head enclosure, is secured to base 100 and to the end of the middle tube 102 at the lower end thereof by a clamp 106. For purposes of securing the nose engaging means 92 and the mouthpiece 94 to the head of the worker, the flexible conduit 98 is grasped by the worker below the clamp 106 and pulled downwardly until the mouthpiece 94 rests against the base 100 and the upper portion of the rigid middle tube 102. The worker grasps the outer tube 104 and the rigid middle tube 102 and urges the middle tube upwardly, causing the nose engaging means 92 and the mouthpiece 94 to move into the proper position. As the conduit 98 is flexible in this conduit arrangement 96, the worker's head is free to turn from side to side and to move upwardly or downwardly.

Figure 10:
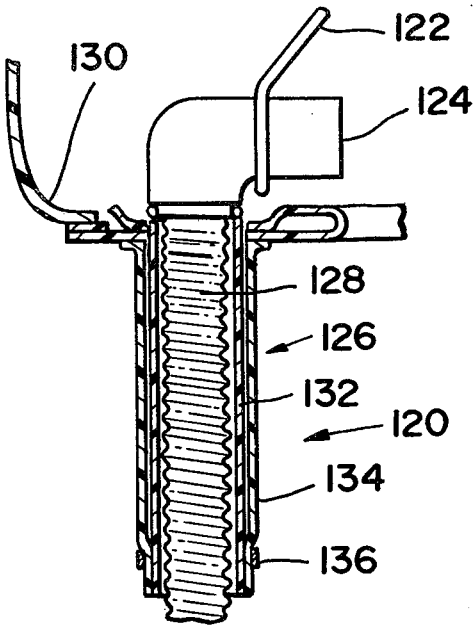
FIGS. 10 through 12 depict side elevational views of sequential steps in placing into operation a portion of yet another alternative embodiment of the invention.
Figure 11:
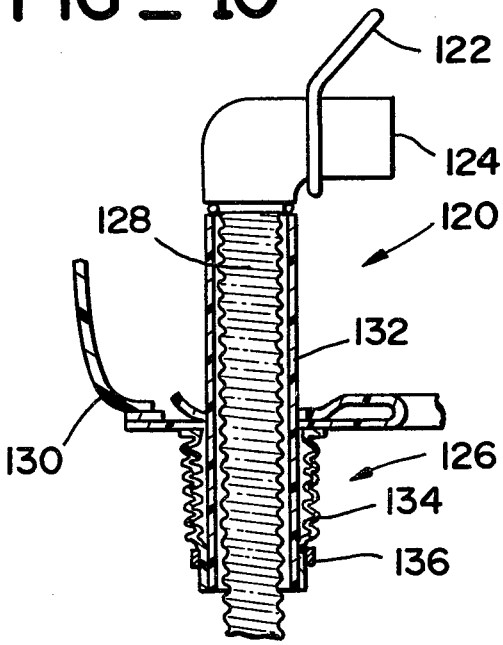
Figure 12:
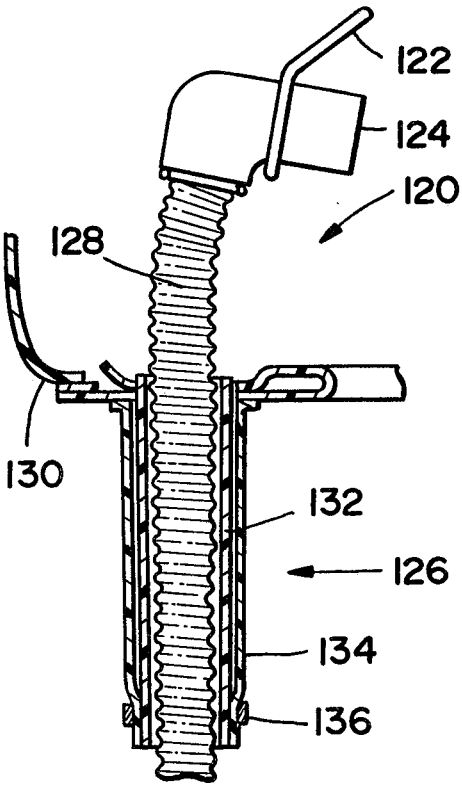

Still a further embodiment of the present invention is shown in FIGS. 10, 11 and 12, and denoted by the numeral 120. This embodiment includes a nose engaging means 122 and a mouthpiece 124, which are similar to the nose engaging means and mouthpiece shown in FIG. 1. The conduit arrangement 126 includes a flexible inner conduit 128 which is connected to the mouthpiece 124. Flexible inner conduit 128 is disposed through an aperture in the base 130 of the head enclosure. Surrounding flexible conduit 128 is a rigid middle conduit 132 which is also disposed through the aperture in the head enclosure 130. Surrounding the rigid middle conduit is a flexible outer conduit 134 which is secured to the head base enclosure 130 about the aperture thereof at one end and at the lower end thereof is secured to the rigid middle conduit 132 by clamp 136. In order to operate this arrangement, the worker grasps the flexible outer conduit 134 and urges the conduit arrangement 126 upwardly, as can be seen in FIG. 11, with the flexible outer conduit 134 collapsing, and the rigid middle conduit 132 urging the nose engaging means 122 and the mouthpiece 124 into the proper position over the worker's nose and in the worker's mouth. Once this is accomplished, the outer flexible conduit 134 can be again extended, with the simultaneous downward movement of the rigid middle conduit 134 exposing the flexible conduit 128. Thus, the worker is free to move his head from side to side and upwardly and downwardly due to the flexible inner conduit 128.

Figure 13:
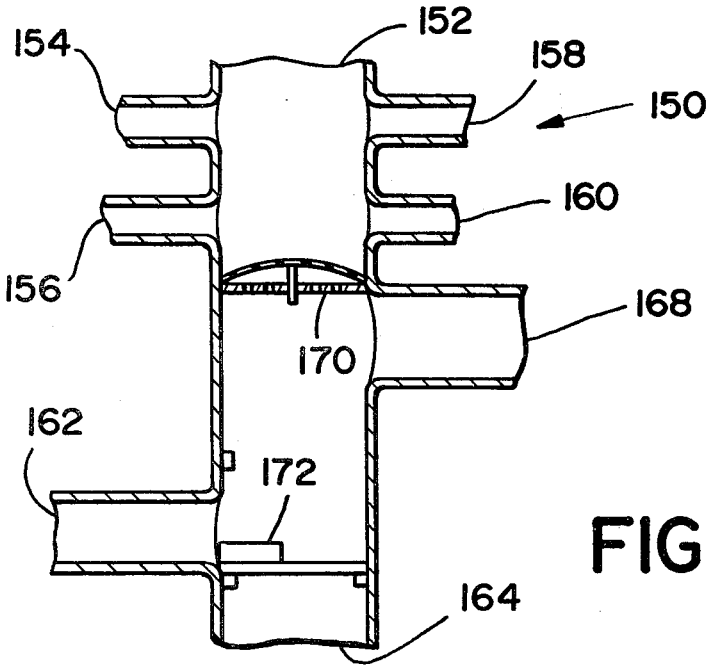
FIG. 13 depicts a manifold for associating the source of air for the primary respiratory system with a source of air for the embodiment of the invention of FIG. 1.

Turning to FIG. 13, a manifold arrangement 150 is depicted. Manifold arrangement 150 can be used to associate the conduit 28 (FIG. 1), which supplies air or oxygen to the head enclosure 26, and conduit 74, which supplies air or oxygen to the mouthpiece 32.

Manifold arrangement 150 includes a first port 152, which can be connected to conduit 28, and ports 154,156,158 and 160, which can be connected to a suit which covers the worker at points (not shown) to supply air to the arm and leg coverings (not shown). Arrangement 150 also includes port 162 which can be secured to a primary source of high pressure air or oxygen, while port 164 can be secured to a secondary source of low pressure air or oxygen. An additional port 168 is secured to conduit 74 of the invention 20. A one-way valve 170 is located in manifold arrangement 150 in order to prevent air from flowing back from ports 152,154,156,158 and 160 into the manifold arrangement 150. Further, a spring-loaded valve 172 is located at the junction between ports 162 and 164. If the primary source of air is functional, the either/or valve 172 will be overcome forcing the valve 172 into the position shown in FIG. 13, allowing air to enter the manifold arrangement 150 and urge the oneway valve 170 open to allow air to enter the ports 152 through 160. If the primary source of air should fail for any reason, the secondary source of air, which can be bottled, or simply the drawing power of the worker's lungs, enables the spring-loaded valve 172 to open up port 164 and close the port 162 to allow the air supply to enter the emergency egress respiratory protection apparatus 20 through port 168. As the air pressure is low, the one-way valve 170 remains closed.

Figure 14:
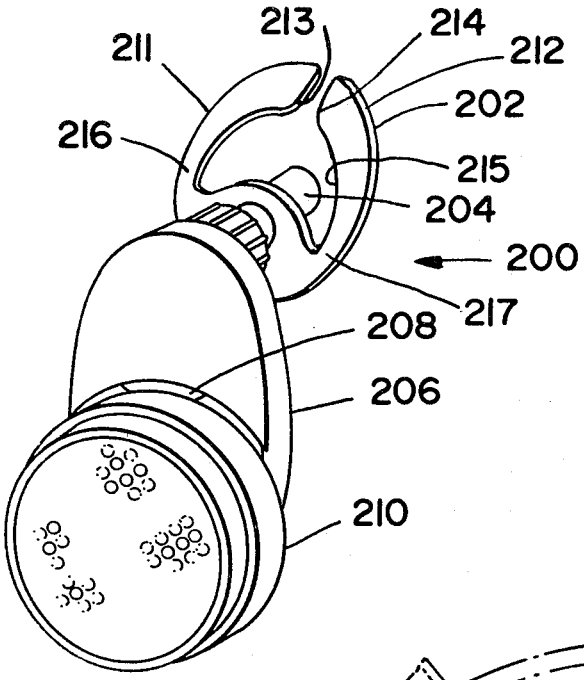
FIG. 14 depicts a perspective view of another alternative embodiment of the invention.
Figure 15:
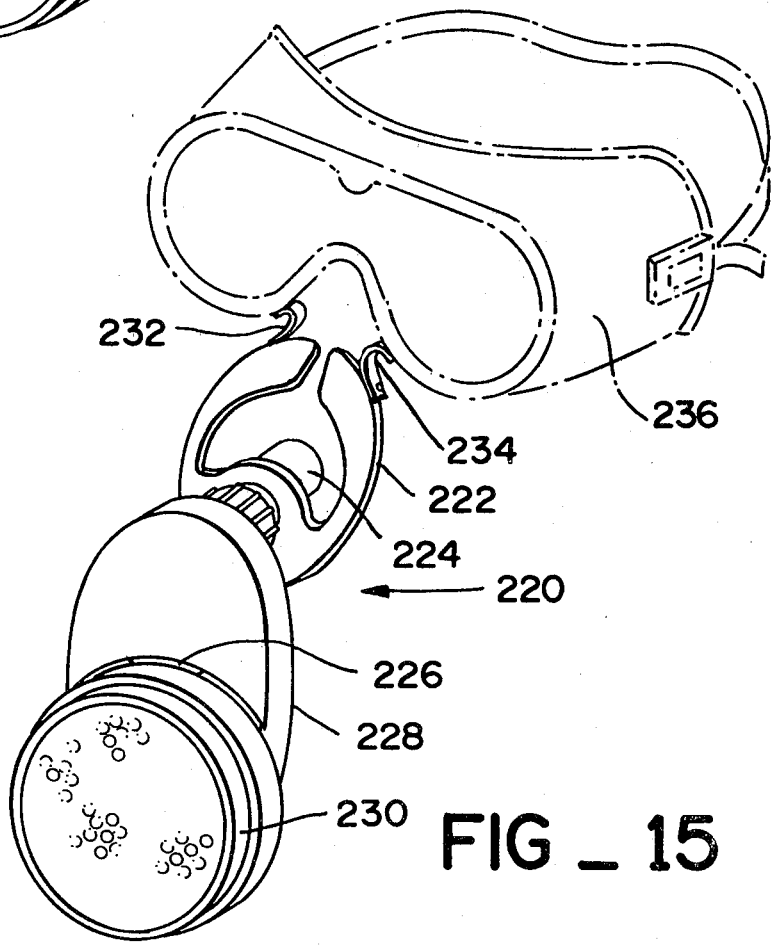
FIG. 15 depicts a perspective view of still another alternative embodiment of the invention.

Still other alternative embodiments of the invention are shown in FIGS. 14 and 15. In FIG. 14, the emergency egress respiratory protection apparatus 200 includes a nose engaging means 202 and a mouthpiece 204 which are similar to the nose clamp and mouthpiece as shown in FIG. 1.

Examining the view of the nose engaging means more closely, it can be seen that urging members 211 and 212 of nose engaging means 202 have flat, spaced-apart juxtaposed surfaces 213 and 214 which, when slid over the nose, urge the outer walls towards the inner wall. The space between surfaces 213 and 214 becomes increasingly greater rearwardly toward mouthpiece 204 in order to accommodate the varying width of the nose and larger end portion of the nose adjacent the nostrils. Aperture 215 also accommodates this portion of the nose. Also, urging members 211 and 212 have cross-sectionally reduced portions 216 and 217, which allow members 211 and 212 to give and flex as nose engaging means 202 is slid over the nose. It is to be understood that the above description of the nose engaging means 202 of FIG. 14 can apply equally well to the other embodiments of the invention.

The apparatus also includes a plenum chamber 206, which houses a valve 208 which is similar in function to valve 36 in FIG. 1. The exhaust from valve 208 exits at area 210. Valve 208 communicates with mouthpiece 204 and with the cavity of plenum 206. Also communicating with the cavity of plenum 206 is a filter unit 210 through which the user draws air.

In operation, this apparatus 200 is quite similar to that of FIG. 1, except that it is meant to be used without the primary respiratory system of FIG. 1. In other words, this unit can be carried with the worker or conveniently located at safety points in the work site and then, should a toxic environment arise, the worker could immediately place the nose engaging means 202 over his nose and the mouthpiece 204 in his mouth, and then walk to a safe location.

FIG. 15 depicts yet another embodiment of the respiratory protection apparatus 220. This apparatus is similar to that in FIG. 14, and includes a nose engaging means 222, a mouthpiece 224, a valve 226, a plenum 228, and a filter 230. The nose engaging means 222 is secured to straps 233 and 234, which are themselves secured to the nose bridge of safety goggles 236. The safety goggles can be placed over the worker's eyes and the apparatus 200 secured to the nose and mouth of the worker, much in the same way that the apparatus 200 is so secured.

From the above, it can be seen that the respiratory protection apparatus can be operated and properly positioned with use of only one hand, in combination with or apart from a primary respiratory system, and that the apparatus is designed to easily and conveniently fit a wide variety of faces with different contours and shapes.

Other aspects, objects, and advantages of the invention can be obtained from a study of the drawings, the disclosure, and the appended claims.

I claim:

1. In combination with a primary respiratory system including a head enclosure and means adapted for supplying air to said head enclosure, an emergency egress respiratory protection apparatus at least partially extending into said head enclosure through an aperture therein, said emergency egress respiratory protection apparatus comprising:

a nose-engaging means for urging the outer walls of a nose toward the inner wall thereof, which means includes spaced apart urging members;

a mouthpiece, said nose-engaging means rigidly secured to said mouthpiece;

conduit means for supplying air to said mouthpiece, said conduit means including a rigid inner conduit rigidly secured in communication with said mouthpiece so that said conduit means can be used to direct said nose-engaging means onto the nose;

a collapsible outer conduit surrounding said rigid inner conduit having one end sealed about said aperture through said head enclosure of said primary respiratory system with the other end thereof sealingly secured to said rigid inner conduit distally from said mouthpiece, said collapsible outer conduit being collapsed as the rigid inner conduit urges the nose-engaging means onto the nose;

valve means communicating with said conduit means for allowing inhalation and exhalation of air, said valve means adapted to be connected to a source of air.

2. The apparatus of claim 1 wherein said nose engaging means includes a base secured to said mouthpiece and said urging members extend from said base, said urging members having juxtaposed and spaced apart flat surfaces which can be slipped over the nose to urge the outer walls of the nose toward the inner wall of the nose.

3. The apparatus of claim 2 wherein the urging members define therebetween an aperture for receiving at least a portion of the nose.

4. The apparatus of claim 1 wherein said urging members are positioned upwardly away from said mouthpiece.

5. The apparatus of claim 1 wherein said mouthpiece includes a hard, non-deformable inner tube and a softer deformable outer tube.

6. The apparatus of claim 1 wherein said urging members have juxtaposed flat surfaces, the space therebetween becoming increasingly greater therealong to accommodate the urging width of the nose.

7. The apparatus of claim 6 wherein said nose engaging means includes an aperture communicating with the flat surfaces to accommodate the end of the nose.

8. The apparatus of claim 1 wherein said urging members have cross-sectionally reduced portions to increase the flexibility thereof.

9. The combination of claim 1 including:

a manifold means for communicating with means adapted for supplying air to said head enclosure and said valve means and adapted to communicate with sources of air for said primary respiratory system and said emergency egress respiratory protective apparatus, said manifold means including a first valve for allowing air to enter either from said source of air for said primary respiratory system or for said emergency egress respiratory protection apparatus, and a second valve to allow air to enter said head enclosure, wherein the air pressure for the source for the respiratory system is greater than the air pressure for the source for the protective apparatus and the second valve only comes open with air supplied to the manifold means from the source for the respiratory system.

* * * * *

UNITED STATES PATENT OFFICE

CERTIFICATE OF CORRECTION

Patent No. 4,452,240 Dated June 5, 1984

Inventor(s) ANTHONY L. MORETTI

It is certified that error appears in the above-identified patent and that said Letters Patent are hereby corrected as shown below:

Column 2, line 39 - Delete "those" and insert --said--.

Column 2, line 68 - Delete "arrangementt" and insert --arrangement--.

Signed and Sealed this

Twentieth Day of November 1984

[SEAL]

Attest:

GERALD J. MOSSINGHOFF

Attesting Officer

Commissioner of Patents and Trademarks

UNITED STATES PATENT OFFICE

CERTIFICATE OF CORRECTION

Patent No. 4,452,240 Dated June 5, 1984

Inventor(s) ANTHONY L. MORETTI

It is certified that error appears in the above-identified patent and that said Letters Patent are hereby corrected as shown below:

Cover Page, Item [73] - Delete "Bridgeway" and insert --Sausalito--.

Signed and Sealed this

*Fifth* Day of *March 1985*

[SEAL]

*Attest:*

DONALD J. QUIGG

*Attesting Officer* *Acting Commissioner of Patents and Trademarks*